US011306468B2

(12) United States Patent
Harrison

(10) Patent No.: US 11,306,468 B2
(45) Date of Patent: Apr. 19, 2022

(54) TISSUE WETTING RESERVOIR FOR A COMMODE

(71) Applicant: Kenneth Harrison, Palm Beach Gardens, FL (US)

(72) Inventor: Kenneth Harrison, Palm Beach Gardens, FL (US)

( * ) Notice: Subject to any disclaimer, the term of this patent is extended or adjusted under 35 U.S.C. 154(b) by 0 days.

(21) Appl. No.: 17/173,251

(22) Filed: Feb. 11, 2021

(65) Prior Publication Data

US 2021/0301510 A1 Sep. 30, 2021

Related U.S. Application Data

(60) Provisional application No. 63/001,878, filed on Mar. 30, 2020.

(51) Int. Cl.
*E03D 1/00* (2006.01)
*A47K 10/32* (2006.01)
*E03D 1/26* (2006.01)

(52) U.S. Cl.
CPC ..... *E03D 1/003* (2013.01); *A47K 10/32* (2013.01); *A47K 2010/328* (2013.01); *E03D 1/266* (2013.01)

(58) Field of Classification Search
CPC .... E03D 1/003; E03D 1/266; A47K 2010/328
USPC ..... 4/661
See application file for complete search history.

(56) References Cited

U.S. PATENT DOCUMENTS

| | | | | |
|---|---|---|---|---|
| 2,545,338 | A | 3/1951 | Bowden | |
| 2,083,374 | A | 4/1963 | Watlington | |
| 3,428,964 | A * | 2/1969 | Lucas | E03D 1/01 4/665 |
| 3,735,428 | A * | 5/1973 | Olivero | E03D 1/003 4/341 |
| 3,979,781 | A | 9/1976 | Jolicoeur | |
| 4,451,943 | A | 6/1984 | Nibler | |
| 5,044,556 | A | 9/1991 | Suzuki | |
| 5,359,738 | A | 11/1994 | Kurtz | |
| 5,381,568 | A | 1/1995 | Warkentin | |
| 6,675,405 | B1 | 1/2004 | Harm | |
| 8,554,676 | B2 | 10/2013 | Grant | |
| 2005/0183194 | A1 | 8/2005 | Haile, Jr. | |
| 2006/0150318 | A1 | 7/2006 | Harm | |
| 2017/0066572 | A1 | 3/2017 | Marchitello | |
| 2017/0362805 | A1 | 12/2017 | Bruce | |

FOREIGN PATENT DOCUMENTS

| | | |
|---|---|---|
| EP | 2840192 | 2/2015 |

* cited by examiner

*Primary Examiner* — Huyen D Le
(74) *Attorney, Agent, or Firm* — McHale & Slavin, P.A.

(57) ABSTRACT

The commode having a catch basin attached to the water reservoir tank at a position above the water reservoir tank water line. A pressurized water line is used to supply fresh water to a nozzle mounted in the catch basin. An actuator allows water to be dispensed through the nozzle for the purposes of moistening toilet paper. The catch basin includes a lower drain hole in fluid communication with the flush tank to drain water therein at a predetermined rate, and an upper opening draining into the flush tank to prevent overflowing of said catch basin.

15 Claims, 4 Drawing Sheets

TISSUE WETTING RESERVOIR FOR A COMMODE

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 63/001,878, entitled "COMMODE RESERVOIR", and filed Mar. 30, 2020; the contents of which are incorporated herein by reference.

FIELD OF THE INVENTION

The present invention generally relates to the field of commodes; and more particularly, to an accessory for use with a toilet which dispenses water into a catch basin positioned on the exterior of a water reservoir tank above the water line in the tank.

BACKGROUND OF THE INVENTION

Toilet paper is the preferred material for use in cleansing the rectal and genital area immediately after a bowel movement or urination. However, conventional toilet paper is dry, making it uncomfortable and ineffective at times for removal of fecal matter or urine. Additionally, for those who suffer with hemorrhoids, piles, or similar rectal tissue irritations, the use of dry paper can be very painful.

Utilizing a "wet" cleansing method is considered a more sanitary, comfortable and effective means of cleansing the rectal and genital areas, thereby making the wet cleansing method more advantageous than the dry paper method in most all instances. The use of water for rectal and genital cleaning has been commonplace in Europe for years, primarily in the form of a bidet. However, bidets were never widely accepted in the United States, due largely to the additional space requirements, such as having a separate room for a bidet fixture in the bathroom. In addition, a bidet is an expensive addition to any property. The use of wet wipes, which are pre-moistened towelettes, is promoted as an alternative to the bidet. However, towelettes are slow to dissolve and require higher drain flow rates then cellulose based toilet paper to prevent clogging of waste drain pipes.

U.S. Pat. No. 2,545,338 and U.S. Patent Application Publication No. 2017/0362805 disclose a reservoir that is positioned below the water line of the flush tank so that it fills and empties with the flush tank water level through a drain opening on the bottom of the reservoir and into the flush tank. The disadvantage to such a device is the water from an unsealed tank, wherein the water can be contaminated as it is drawn from inside the holding tank and the reservoir is left filled between tank flushes. Furthermore, water left in the open reservoir is subject to air borne contamination.

Several prior art devices make use of a spraying nozzle from a water source for the purpose of moistening toilet paper. U.S. Pat. No. 5,359,738 discloses a reservoir using a dispensing lever and a thumb operated spring biased handle to open an air vent to allow water to dispense from a nozzle. U.S. Pat. No. 6,675,405 and U.S. Patent Application Publication No. 2006/0150318 disclose a tube that carries water to a housing mounted next to the toilet seat and sprays a mist of water that the individual must catch. In operation, the user pushes their palm downward on a plunger operator to cause a release of water. U.S. Pat. No. 3,979,781 discloses a nozzle and reservoir mounted outside the toilet seat, whereby excess water is expelled into the toilet bowl. Although these prior art devices provide fresh water to the reservoir, the reservoir is located next to the toilet seat, which subjects the reservoir to contamination from urine.

What is needed in the art is a catch basin located on the side of the water reservoir tank of a commode that provides a flow of water upon demand, and allows for drainage of the water to prevent stagnant water issues.

SUMMARY OF THE INVENTION

The instant invention provides a commode reservoir comprised of a catch basin and a pressurized water line, the catch basin being attached to the exterior wall of a water reservoir tank and positioned above the water-line inside the water reservoir tank. A pressurized water line connected to a fresh water source is used to dispense water through a nozzle into the catch basin for the purpose of moistening toilet paper. The catch basin includes a drain hole in fluid communication with the water reservoir tank to drain water from the catch basin.

Accordingly, it is an objective of the present invention to provide a commode reservoir that allows for moistening of toilet paper for use in cleansing the rectal and genital areas in order to provide a sanitary, comfortable and effective means for cleansing.

Still another objective of the present invention is to provide a catch basin that can be secured to a conventional commode, or formed integral to the commode during manufacturing, that provides a self draining receptacle for use in moistening disposable toilet paper.

Yet another objective of the present invention is to provide a commode reservoir that allows for moistening of toilet paper with fresh clean water dispensed from a spray nozzle for immediate use; the moistened toilet paper maintaining structural integrity for instant use.

Still another objective of the present invention is to provide a catch basin that is installed above the highest water level within the water reservoir tank, thereby allowing the catch basin to expel water from the aperture on the bottom thereof.

Another objective of the present invention is to provide a commode that is more sanitary by placement of a catch basis at a height above the toilet bowl and at a position along a side surface of the commode.

Yet another objective of the present invention is to provide a commode reservoir that includes a secondary opening below the plane of the top surface of the catch basis to allow any overflow of water that is not being expelled quickly enough through the small aperture to also be expelled in order to prevent spill over outside the catch basis.

Still another objective of the present invention is to provide a commode reservoir that includes a pressurized water hose connected to the water supply valve to provide a fresh water source to the catch basin.

Still another objective of the present invention is to provide a commode reservoir that includes a push-button actuator at the end of the pressurized water line to actuate fresh water through a nozzle to be dispensed into the catch basin in a spray mode or a fluid mode.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
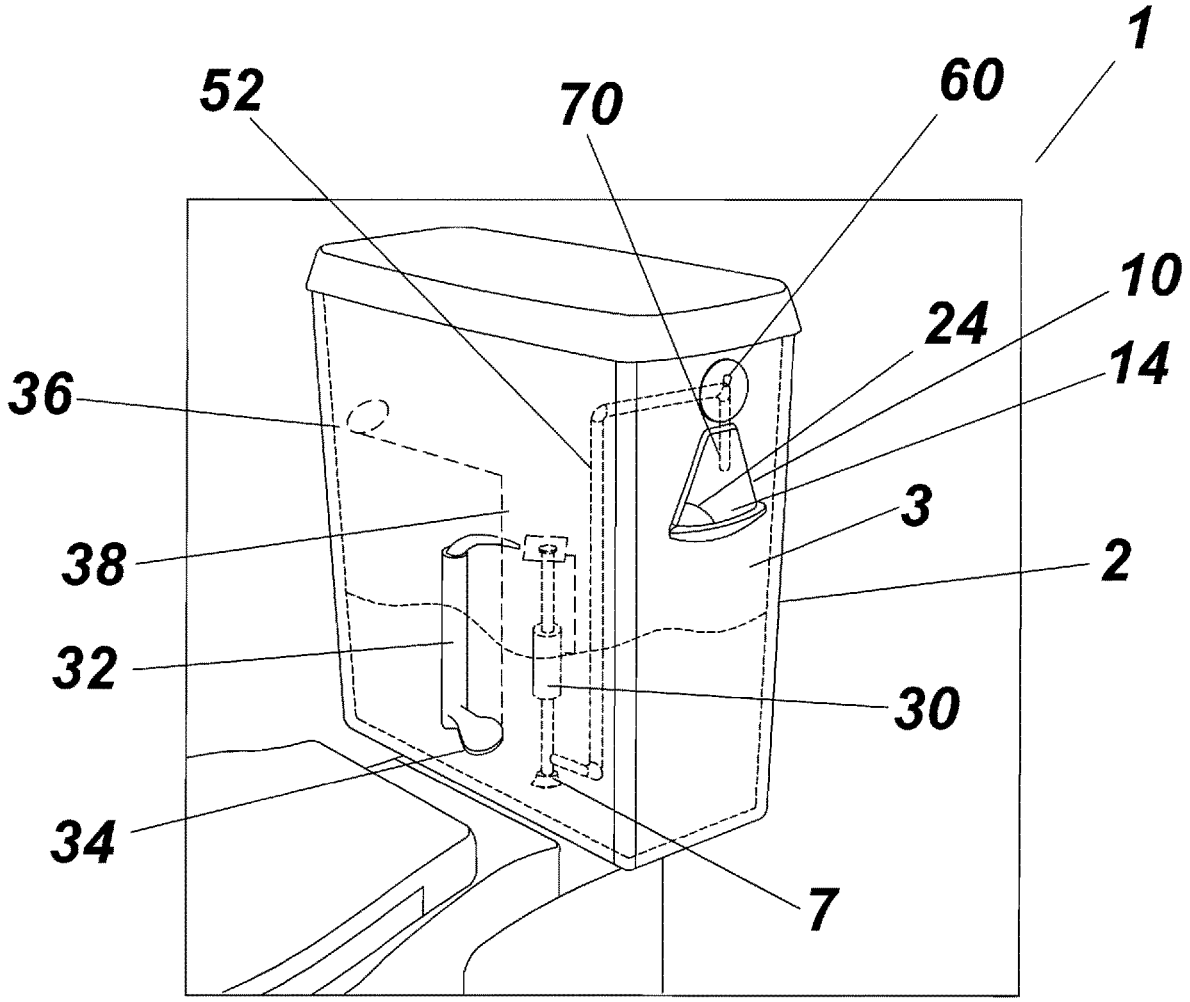
FIG. 1 is a pictorial perspective view of the water reservoir tank and catch basin.
Figure 2:
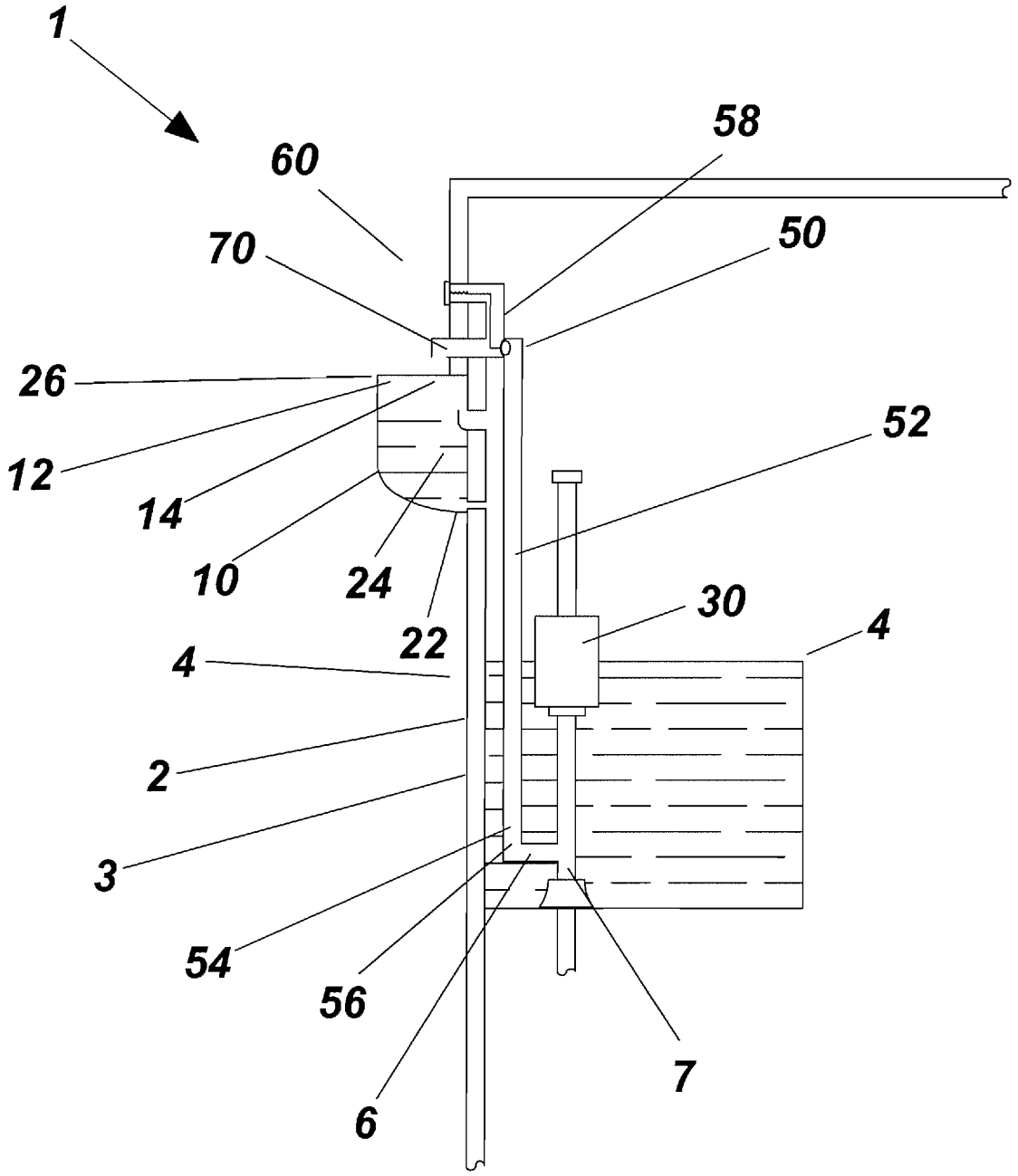
FIG. 2 is a cross-sectional view thereof.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 3:
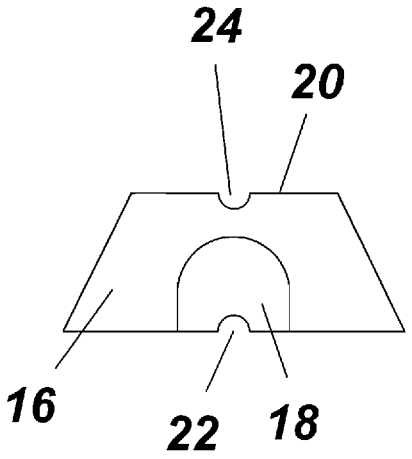
FIG. 3 is a top view of the catch basin.
Figure 4:
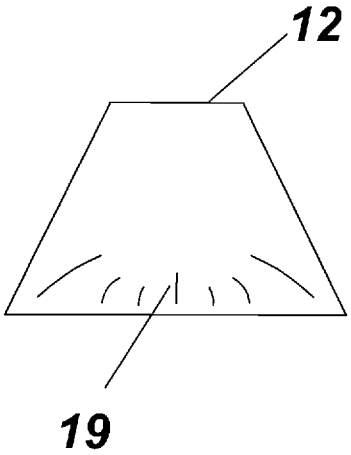
FIG. 4 is a front cross-sectional view of the catch basin.
Figure 5:
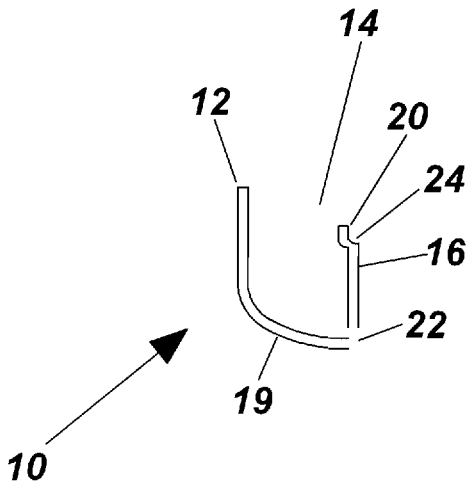
FIG. 5 is a side cross-sectional view of the catch basin.
Figure 6:
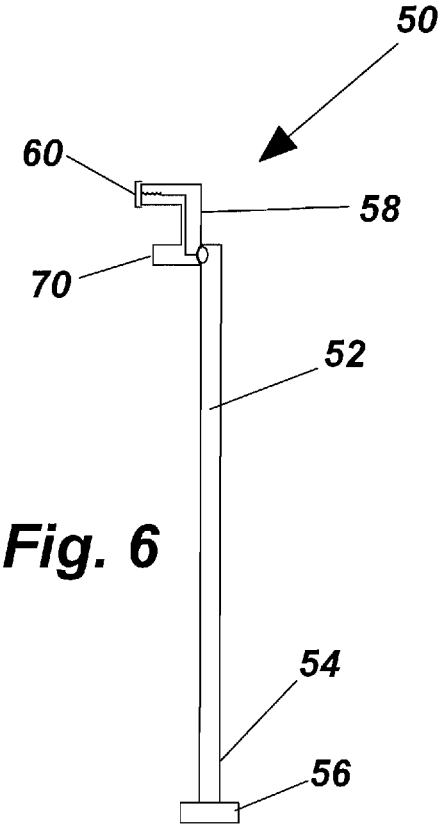
FIG. 6 is a side view of the actuator and nozzle.
Figure 7:
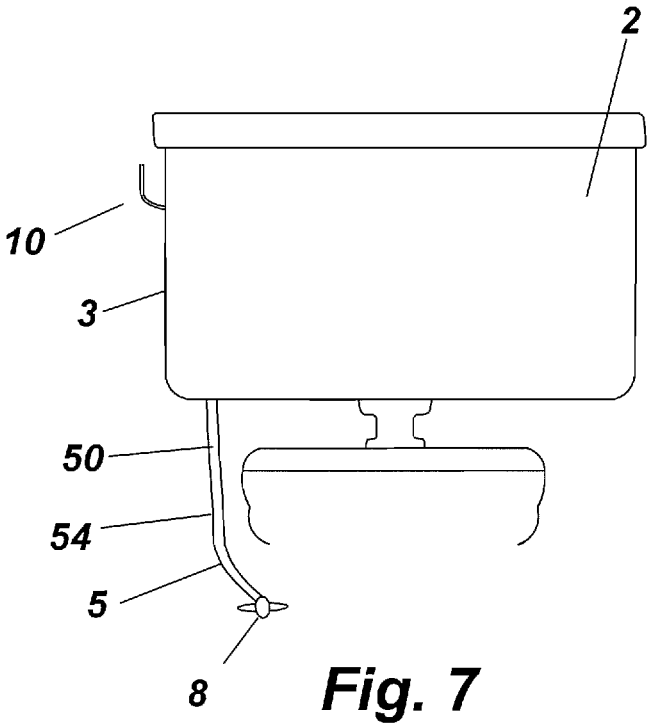
FIG. 7 is a rear view of a pressurized water line system.

Referring now to FIGS. 1-7 in general, the present invention relates to a commode reservoir 1 which is comprised of a catch basin 10 and pressurized external water source 50; the catch basin 10 being attached to, or formed integral therewith, the exterior wall 3 of a water reservoir tank 2 and positioned above the predetermined water line 4 inside the tank 2 shown in FIG. 3. The catch basin 10 has a U-shaped cross-section; however, other shapes are contemplated. The catch basin 10 has a top opening 12 defining an open trough 14. The back side 16 of the catch basin 10 includes a drain hole 22 on the bottom portion 18 thereof, sized to allow water to slowly drain into the water reservoir tank 2 at a point above the water line 4. The catch basin 10 has a contoured bowl shape, wherein an upper portion of said catch basin is larger in width than a lower portion of said catch basin, that congregates at the drain hole 22 so that water collected in the catch basin will slowly drain into the water reservoir tank 2.

On the top portion 20 of the back side 16 of the catch basin 10 is a secondary overflow opening 24 that protects from overflow. The secondary overflow opening 24 is positioned above the drain hole 22, but below the plane of the top surface 12 of the outer wall 19 to allow any overflow of water that is not being drained quickly enough through the drain hole 22 to be expelled in order to prevent spillage outside the catch basin 10. The drain hole 22 is sized and shaped to allow a specific amount of water to be expelled into the water reservoir tank 2, because it is imperative to allow the catch basin 10 to maintain a pool of water therein for a specific amount of time so that the user has time to moisten toilet paper. A pooling or collection of water can begin to form within the catch basin 10 because the drain hole 22 is sized to allow only a specific amount of water to be expelled therefrom. The secondary overflow opening 24 prevents the pooling of water from becoming high enough to overflow outside the catch basin 10, thus the secondary overflow opening 24 is positioned just below the top surface 12 of the catch basin 10 and sized to allow a greater amount of water to expel into the water reservoir tank 2 than the drain hole 22. Preferably the catch basin, drain hole, and secondary opening are formed integral with the water reservoir tank 2. The water reservoir tank 2 has a conventional fill valve 7 operated by a buoyant float member 30 for maintaining the water level 4 at a predetermined amount. An overflow tube 32 secures the drain flap 34, which is manually operated by a flush handle 36 connected to the drain flap 34 by a flexible link 38.

The pressurized water line system 50 includes a hose 52, a push-button actuator 60, and a nozzle 70 to dispense clean water into the catch basin 10 for the purpose of moistening toilet paper. The hose 52 has a first end 54 that is connected to the fresh water supply valve 7, in a manner to assure only fresh potable water is directed to the nozzle 70, no water previously exposed in the water reservoir tank 2 is utilized. A second end 58 includes a push-button actuator 60 that allows the fresh water to be directed to the nozzle 70. In one embodiment, the first end 54 of the hose 52 includes a hose coupling 56 to attach to the water supply valve 4, and it is likely that the connection to the water supply valve 4 would require splitting thereof. The push-button actuator 60 and the nozzle 70 are installed onto the exterior wall 3 of the flush tank 2. The nozzle 70 is positioned above the catch basin 10 so that the water expelled therefrom is captured within the catch basin 10. By actuating the push-button 60, the nozzle 70 will mist or spray water into the catch basin 10. The push-button actuator 60 is spring biased and operates as an on-off valve. It is contemplated that the push-button actuator 60 can be held down so that a greater volume of water, rather than a mist, can be expelled from the nozzle 70.

In use, the user would depress the push-button actuator 60 in order to expel water from the nozzle 70. The user would keep the push-button actuator 60 depressed longer in order to have a continuous stream of water expel from the nozzle 70; or the user could depress once to allow a specific, or pre-determined, amount of water to be expelled from the nozzle 70. The water would then be expelled from the nozzle 70 and either be used to directly moisten toilet paper, or direct water to the catch basin 10. In this manner, the water would pool within the catch basin 10 so that the user has a pool of water to moisten the toilet paper. Water would drain from the drain hole 22 at the bottom of the catch basin 10 slowly at a rate far less than the amount of water that is directed to the catch basin upon depressing the push-button actuator 60. In the event that the user depresses the push-button 60 for a long period of time and the pool of water in the catch basin 10 starts to reach the top surface 12 of the catch basin 10, the water would then be drained through the overflow opening 24, which is located below the top surface 12 of the catch basin 10.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A tissue wetting device for a commode, said commode having a toilet bowl with an upper flange for support of a toilet seat, a toilet seat cover, and a water reservoir tank housing a float valve fluidly coupled to a pressurized water source and a water outlet through a flap valve in fluid communication with said toilet bowl, and a handle for operating of said flap valve, causing water stored in said water reservoir tank to flush said water outlet of said toilet bowl, said float valve constructed and arranged to maintain said water reservoir tank to a predetermined water level, said toilet tissue wetting device comprising:

a catch basin positioned on a side wall of said water reservoir tank, said catch basin having a back side congregating with a front side to form an open trough;

a drain hole aperture formed along a bottom of said catch basin, said drain hole aperture located at a point above the predetermined water level of said water reservoir tank;

a nozzle positioned along an upper portion of said catch basin constructed and arranged to dispense water into said catch basin; and an actuator positioned between said pressurized water source and said nozzle, said actuator directing water to said nozzle;

wherein said catch basin is available for receipt of water for wetting toilet paper, whereby unused water collected in said catch basin is drained into said water reservoir tank.

2. The tissue wetting device according to claim 1 including an overflow opening forming a secondary drain hole positioned along an upper portion of said catch basin back wall, which is constructed and arranged to drain excess water from said catch basin to said water reservoir.

3. The tissue wetting device according to claim 1 wherein said drain hole aperture is sized to allow water collected in said open trough to drain at a predetermined rate into said water reservoir tank.

4. The tissue wetting device according to claim 1 wherein said catch basin is contoured bowl shaped, wherein an upper portion of said catch basin is larger in width than a lower portion of said catch basin.

5. The tissue wetting device according to claim 1 wherein said actuator is a manually operated spring biased push button valve.

6. The tissue wetting device according to claim 5 wherein momentary depressing of said push button dispenses a mist through said nozzle.

7. The tissue wetting device according to claim 5 wherein continued depressing of said push button allows a pool of water to enter said catch basin.

8. The tissue wetting device according to claim 1 wherein said catch basin is formed integral with said water reservoir tank.

9. The tissue wetting device according to claim 1 wherein said back side of said catch basin is a side wall of said water reservoir tank.

10. A tissue wetting device for a commode, said commode having a toilet bowl with an upper flange for support of a toilet seat, a toilet seat cover, and a water reservoir tank, said water reservoir tank housing a float valve fluidly coupled to a pressurized water source and a water outlet through a flap valve in fluid communication with said toilet bowl, and a handle for operating of said flap valve, causing water stored in said water reservoir tank to flush said toilet bowl, said float valve constructed and arranged to maintain said water reservoir tank at a predetermined water level, said toilet tissue wetting device comprising:

a catch basin positioned on a side wall of said water reservoir tank, said catch basin having a back side formed from a side wall of said water reservoir tank, and a front side congregating with said back side to form a contoured bowl shaped trough;

a drain hole aperture formed in said bottom wall of said catch basin, said drain hole aperture located at a point above the predetermined water level of said water reservoir tank, said aperture sized to allow water collected in said open trough to drain into said water reservoir tank;

an overflow opening forming a secondary drain hole positioned along an upper portion of said catch basin back wall, said overflow opening fluidly coupled to said water reservoir tank;

a nozzle positioned along an upper portion of said catch basin constructed and arranged to dispense water into said catch basin; and an actuator positioned between said pressurized water source and said nozzle, said actuator directing water to said nozzle;

wherein said catch basin is available for receipt of water for wetting toilet paper, whereby unused water collected in said catch basin is drained into said water reservoir tank.

11. The tissue wetting device according to claim 10 wherein said actuator is a manually operated spring biased push button valve.

12. The tissue wetting device according to claim 11 wherein momentary depressing of said push button dispenses a mist through said nozzle.

13. The tissue wetting device according to claim 11 wherein continued depressing of said push button allows a pool of water to collect in said catch basin.

14. The tissue wetting device according to claim 10 wherein said catch basin is formed integral with said water reservoir tank.

15. The tissue wetting device according to claim 10 wherein said catch basin is attached to a side wall of said water reservoir tank.

* * * * *